US007655878B2

(12) United States Patent
Nishimura

(10) Patent No.: US 7,655,878 B2
(45) Date of Patent: Feb. 2, 2010

(54) KEY SHEET AND KEY SHEET MANUFACTURING METHOD

(75) Inventor: Takeshi Nishimura, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 1079 days.

(21) Appl. No.: 11/181,749

(22) Filed: Jul. 15, 2005

(65) Prior Publication Data

US 2006/0017693 A1 Jan. 26, 2006

(30) Foreign Application Priority Data

Jul. 20, 2004 (JP) ..... 2004-212111

(51) Int. Cl.
*H01H 33/06* (2006.01)

(52) U.S. Cl. ..... 200/512; 200/314

(58) Field of Classification Search ..... 200/310–315, 200/341–345, 512–520
See application file for complete search history.

(56) References Cited

U.S. PATENT DOCUMENTS

| | | | | |
|---|---|---|---|---|
| RE29,440 | E * | 10/1977 | Durkee et al. | 200/5 A |
| 4,732,724 | A | 3/1988 | Sterner | |
| 5,664,667 | A * | 9/1997 | Kenmochi | 200/512 |
| 6,967,292 | B2 * | 11/2005 | Nishimura | 200/5 R |

FOREIGN PATENT DOCUMENTS

| | | |
|---|---|---|
| EP | 0 162 037 | 11/1985 |
| EP | 1 484 778 | 12/2004 |
| JP | 63-18727 U | 2/1988 |
| JP | 07 008927 | 2/1995 |
| JP | 08-096653 A | 4/1996 |
| JP | 11-144549 | 5/1999 |
| JP | 2003-178639 | 6/2003 |
| WO | WO-2005/093770 | 10/2005 |

OTHER PUBLICATIONS

European Search Report dated Nov. 2, 2006.
Office Action for Japanese Patent App. No. 2004-212111 (Mailing Date: Oct. 30, 2009) from the Japan Patent Office.

* cited by examiner

*Primary Examiner*—Renee S Iuebke
*Assistant Examiner*—Lisa Klaus
(74) *Attorney, Agent, or Firm*—Cermak Kenealy Vaidya & Nakajima LLP; Tomoko Nakajima

(57) ABSTRACT

Disclosed is a key sheet having a base sheet equipped with a hard resin plate and a key sheet manufacturing method, wherein a reduction is achieved in the thickness of the base sheet and in the effort and cost for the molding. Further, accurate depressing operation is realized without impairing the outward appearance of the key sheet. The key sheet has a hard base plate having a communicating groove connecting through-holes with each other. The communicating groove has a connecting portion formed so as to be continuous and integral with operating portions formed respectively at the through-holes. Thus, there is no need to form inlets for a rubber-like elastic material respectively corresponding to the through-holes in the mold. As a result, the mold structure can be simplified to thereby achieve a reduction in cost. Further, since the entire front or back surface of the hard base plate is not covered with the rubber-like elastic material, it is possible to achieve an overall reduction in the thickness of the base sheet.

14 Claims, 11 Drawing Sheets

KEY SHEET AND KEY SHEET MANUFACTURING METHOD

BACKGROUND OF THE INVENTION

1. Field of the Invention

The present invention relates to a pushbutton switch key sheet for use in an operating portion of various apparatuses, such as a mobile phone, a personal digital assistant (PDA), a car navigation apparatus, or a car audio apparatus, and more particularly to a key sheet having keytops on a rigid base sheet.

2. Description of the Related Art

As a pushbutton switch key sheet for use in an operating portion of various apparatuses, there is widely used one in which keytops are attached by adhesive to a base sheet formed of a rubber-like elastic material (See JP 11-144549 A). Recently, however, from a viewpoint of outward appearance and diversity in design, there has been increasing a demand for a key sheet using a base sheet using as the base a hard resin plate instead of a base sheet formed of a rubber-like elastic material (See JP 2003-178639 A).

In such a key sheet, a base sheet is formed such that a plurality of through-holes are formed in a thin hard resin plate, and each of the through-holes is covered with a thin-walled operating portion consisting of a rubber-like elastic material. A keytop is fixed to each operating portion by an adhesive or the like, thus a key sheet is formed (See JP 2003-178639 A, the first embodiment (paragraph 0014, FIG. 1)).

This conventional key sheet, however, has a problem in that its molding takes effort, resulting in a rather high cost. That is, to manufacture the base sheet, it is necessary to form in the mold an inlet for the rubber-like elastic material corresponding to each through-hole of the hard resin plate. After molding, it is also necessary to perform gate cutting for each through-hole. This leads to a rather complicated mold structure, resulting in high cost and an increase in operational burden after molding.

Further, when the operating portions are formed by injection molding using a rubber-like elastic material such as a thermoplastic elastomer, there are formed relatively large protrusion-like molding marks on the front or the back surfaces of the operating portions. That is, when the molding marks protrude on the front surfaces of the operating portions, the keytops, which are attached by adhesive or the like, are attached obliquely, thereby impairing the outward appearance of the key sheet. When the molding marks protrude on the back surfaces of the operating portions, the contact switch of the printed circuit board is turned on/off by the molding marks at the time of depression of the keytops, so there is a fear of accurate depressing operation being hindered. Further, in the case of an illumination type key sheet, the existence of the molding marks in the operating portions leads to unevenness in illumination of the keytops, so there is also a fear of the outward appearance of the key sheet when the illumination as been impaired.

As means for solving the above-mentioned problems, there has been proposed a key sheet in which a rubber-like elastic material film is formed so as to cover the entire front or back surface of a hard resin plate while filling each through-hole (See JP 2003-178639 A, second embodiment (paragraphs 0016, 0017, FIG. 2), and third embodiment (paragraphs 0018, 0019, FIG. 3)).

In this conventional key sheet, however, the rubber-like elastic material film covers one surface of the hard resin plate, which means that the thickness of the rubber-like elastic material film is added to the thickness of the hard resin plate, with the result that the thickness of the base sheet as a whole increases. In particular, this conventional key sheet is not applicable to an apparatus of which a reduction in thickness on the order of millimeters or less is required, as in the case of an electronic device.

DISCLOSURE OF THE INVENTION

The present invention has been made in view of the above-mentioned problems in the prior art. It is an object of the present invention to provide a key sheet of the type whose base plate is equipped with a hard base plate, such as a hard resin plate, in which it is possible to achieve a reduction in effort and cost for molding while achieving a reduction in thickness, and a method of manufacturing such a key sheet. Another object of the present invention is to provide a key sheet which helps to realize accurate depressing operation without impairing the outward appearance thereof, and a method of manufacturing such a key sheet.

In order to attain the above-mentioned objects, the present invention provides a key sheet including: a base sheet having a hard base plate with a plurality of through-holes; operating portions formed of a rubber-like elastic material and elastically supporting key tops at the through-holes so as to allow displacement under pressurization, characterized in that the hard base plate has a communicating groove leading to a plurality of through-holes, and in that a connecting portion connecting operating portions is integrally formed in the communicating groove.

In this key sheet, there is formed in the hard base plate a communicating groove leading to the plurality of through-holes to connect the plurality of through-holes as a series of spaces, and there is integrally formed in the communicating groove a connecting portion connecting the operating portions with each other so as to be continuous with the operating portions. As a result, there is no need to form in the mold inlets for the rubber-like elastic material corresponding to the individual through-holes, so the mold structure is simplified, thereby achieving a reduction in cost. Further, since a plurality of operating portions are integrally formed through the connecting portion of the communicating groove, so there is no need to cover the front or back surface of the hard base plate with a rubber-like elastic material, making it possible to achieve a general reduction in the thickness of the base plate.

The key sheet is formed such that the upper surfaces of the operating portions elastically supporting the keytops are formed at in-hole positions that are lower than the surface of the hard base plate. In this construction, even if the keytops are fixed to the operating portions through the intermediation of adhesion layers, it is possible to reduce the height of the fixed keytops since the upper surfaces of the operating portions are at in-hole positions that are one step lower than the surface of the hard base plate, thus making it possible to achieve a reduction in the thickness of the key sheet.

In the above-described key sheet, the connecting portion may be formed so as to be within the thickness of the hard base plate. In this structure, the connecting portion does not protrude from the surface of the hard base plate, so it is possible to achieve a reduction in the thickness of the key sheet. Further, it is also possible to form on the connecting portion a buffer portion protruding from the surface of the hard base plate. In this structure, when the key sheet is pressurized by an external force, the buffer portion comes into elastic contact with the printed circuit board, so it is possible to avoid large-pressure contact of the hard base plate; thereby preventing damage or deformation of the printed circuit board.

The above-described key sheet has a molding mark on the connecting portion. In this construction, even in the case in which the operating portions are formed through injection molding of a thermoplastic elastomer, which leaves a relatively large molding mark, the molding mark is on the connecting portion and on none of the operating portions. As a result, there is no fear of the keytops being obliquely fixed due to protrusion of molding marks on the upper surfaces of the operating portions to thereby impair the outward appearance of the key sheet, or of the contact switch being erroneously turned on due to protrusion of molding marks on the lower surfaces of the operating portions. Further, when the key sheet of the present invention is formed as an illumination type key sheet, it is also possible to prevent unevenness in the illumination of the keytops due to molding marks on the operating portions.

In the above-described key sheet, a recess is formed in the connecting portion, and a molding mark exists in the recess. In this construction, even if the connecting portion and the operating portions are formed by injection molding of a thermoplastic elastomer, which leaves a relatively large molding mark, the molding mark remains within the depth of the recess, and does not protrude beyond the surface of the base sheet. As a result, the key sheet can be installed on the printed circuit board of an apparatus in a stable attitude without involving looseness with respect to the printed circuit board.

In the above-described key sheet, a plurality of operating portions and a connecting portion are formed of a translucent rubber-like elastic material, and recesses for accommodating inner light sources to be provided on the apparatus are formed in the connecting portion. In this construction, the light emitted from the inner light sources is guided from the translucent connecting portion to the operating portions, making it possible to brightly illuminate the keytops. Further, in this key sheet, the accommodating recesses have molding marks. In this construction, even if the connecting portion and the operating portions are formed through injection molding of a thermoplastic elastomer, which leaves a relatively large molding mark, no molding mark protrudes beyond the surface of the base sheet due to the depth of the accommodating recesses and the inner light sources. As a result, the key sheet can be installed on the printed circuit board of an apparatus without involving looseness.

Further, in order to achieve the above-mentioned objects, the present invention provides a key sheet manufacturing method in which a hard base plate having a plurality of through-holes is placed in a mold, operating portions blocking the through-holes is formed through molding of a rubber-like elastic material, key tops are then fixed to the operating portions. This method is characterized by including the steps of: forming the hard base plate having a plurality of through-holes and a communicating groove leading to a plurality of through-holes; forming, integrally on the hard base plate, the plurality of operating portions and a connecting portion connecting the operating portions with each other by pouring the rubber-like elastic material from an inlet of the mold, with the inlet being open at a position corresponding to one of the through-holes or the communicating groove; and fixing the key tops respectively to the operating portions.

This key sheet manufacturing method includes the steps of: forming a hard base plate having a plurality of through-holes and a communicating groove leading to the plurality of through-holes; and integrally forming on a hard base plate a plurality of operating portions and a connecting portion connecting the operating portions with each other by pouring a rubber-like elastic material into an inlet of a mold having the inlet at a position corresponding to one of the through-holes or a position corresponding to the communicating groove. Thus, there is no need to form in the mold inlets for the rubber-like elastic material corresponding to the individual through-holes. As a result, the structure of the mold can be simplified, thereby achieving a reduction in cost. Further, a plurality of operating portions are integrally formed through the connecting portion of the communicating groove, so that there is no need to cover the front surface or back surface of the hard base plate with a rubber-like elastic material, making it possible to manufacture a thin key sheet. Further, when using a mold whose inlet is open at a position corresponding to the communicating groove, even if the operating portions are formed through injection molding of a thermoplastic elastomer, which leaves a relatively large molding mark, the molding mark exists on the connecting portion and on none of the operating portions, so there is no disadvantage of the keytops being obliquely fixed to thereby impair the outward appearance of the key sheet due to protrusion of molding marks on the upper surfaces of the operating portions, or of the contact switch being erroneously turned on due to protrusion of molding marks on the lower surfaces of the operating portions. Further, when the key sheet obtained by this manufacturing method is formed as an illumination type key sheet, the key sheet can be one that is free from unevenness in illumination of the keytops due to molding marks on the operating portions.

In the step of forming the operating portions and the connecting portion in the key sheet manufacturing method described above, various types of molding methods, such as injection molding, compression molding, and transfer molding, are applicable according to the type of selected rubber-like elastic material forming the operating portions, etc. Further, the two-color molding method is also applicable to the step of molding the hard base plate and the step of molding the operating portions, etc. of the key sheet manufacturing method described above.

The communicating groove of the hard base plate in each aspect of the present invention described above is formed as a bottomed groove by partially removing the thickness of the hard base plate, or as a hole-shaped groove extending through the thickness of the hard base plate.

Further, the key sheet in each aspect of the present invention described above may be formed as a small-pitch key sheet in which a plurality of closely arranged keytops are collectively exposed through a single opening with no partition frame provided in the casing of an apparatus. In this construction, since the casing has no partition frame, it is possible to make the keytop operating surfaces so much the larger, thereby achieving an improvement in terms of operability.

In the key sheet and the key sheet manufacturing method of the present invention, it is possible to achieve a reduction in production cost through simplification of the mold structure although the base sheet is thin, so it is possible to realize a key sheet which is superior in thinness at low cost. Further, it is possible to realize a key sheet superior not only in thinness but also in outward appearance and operability at low cost.

The above description of the present invention should not be construed restrictively; the objects, advantages, features, and uses of the present invention will become still more apparent from the following description given with reference to the accompanying drawings. Further, it should be understood that all appropriate modifications made without departing from the gist of the present invention are covered by the scope of the present invention.

BRIEF DESCRIPTION OF THE DRAWINGS

In the accompanying drawings:

FIGS. 7A and 7B are sectional views of the key sheet of FIG. 6, in which FIG. 7A is a sectional view of the key sheet taken along the line VII-VII, and FIG. 7B is an enlarged main portion sectional view;

FIGS. 12A and 12B are sectional views of the key sheet of FIG. 10, in which FIG. 12A is a sectional view of the key sheet taken along the line XIIA-XIIA, and FIG. 12B is an enlarged main portion sectional view;

DESCRIPTION OF THE PREFERRED EMBODIMENTS

In the following, embodiments of the key sheet and the key sheet manufacturing method of the present invention will be described with reference to the drawings. In the following description, the present invention will be described, by way of example, as applied to a pushbutton key sheet applicable to an electronic device.

First Embodiment

FIGS. 1 Through 5

Figure 1:
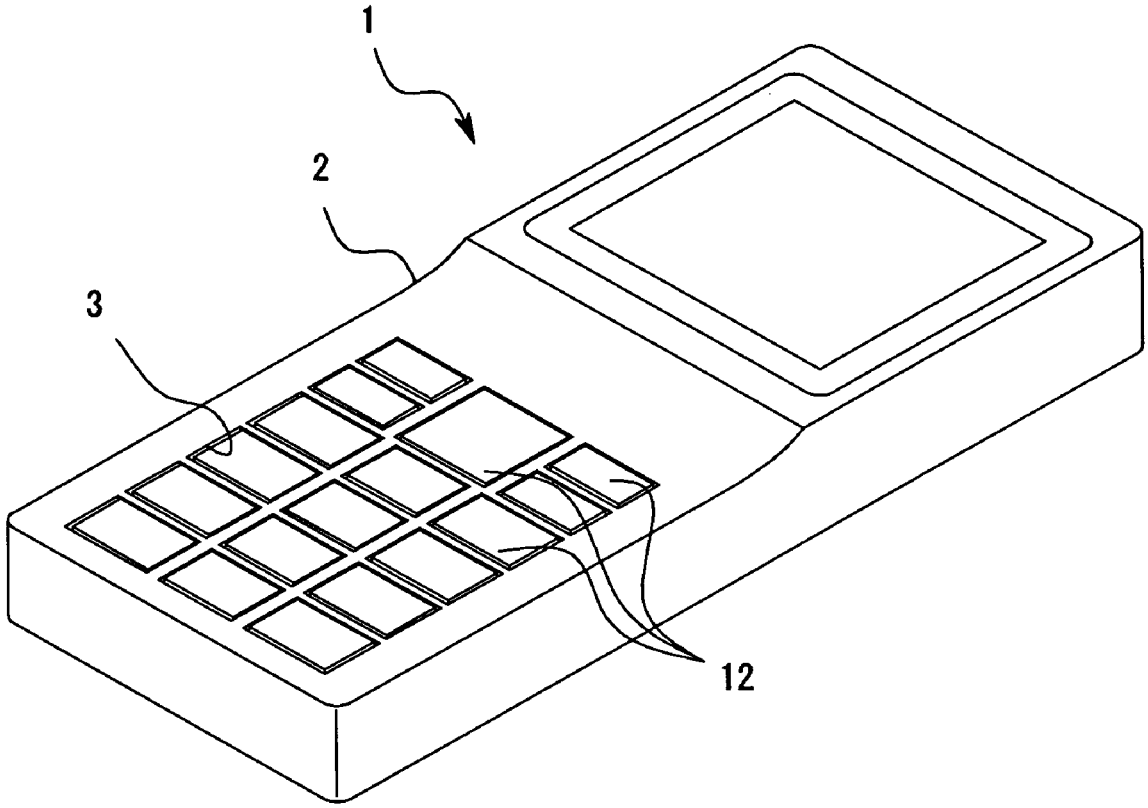
FIG. 1 is an outward perspective view of an electronic device equipped with a key sheet according to one of first through third embodiments of the present invention.
Figure 2:
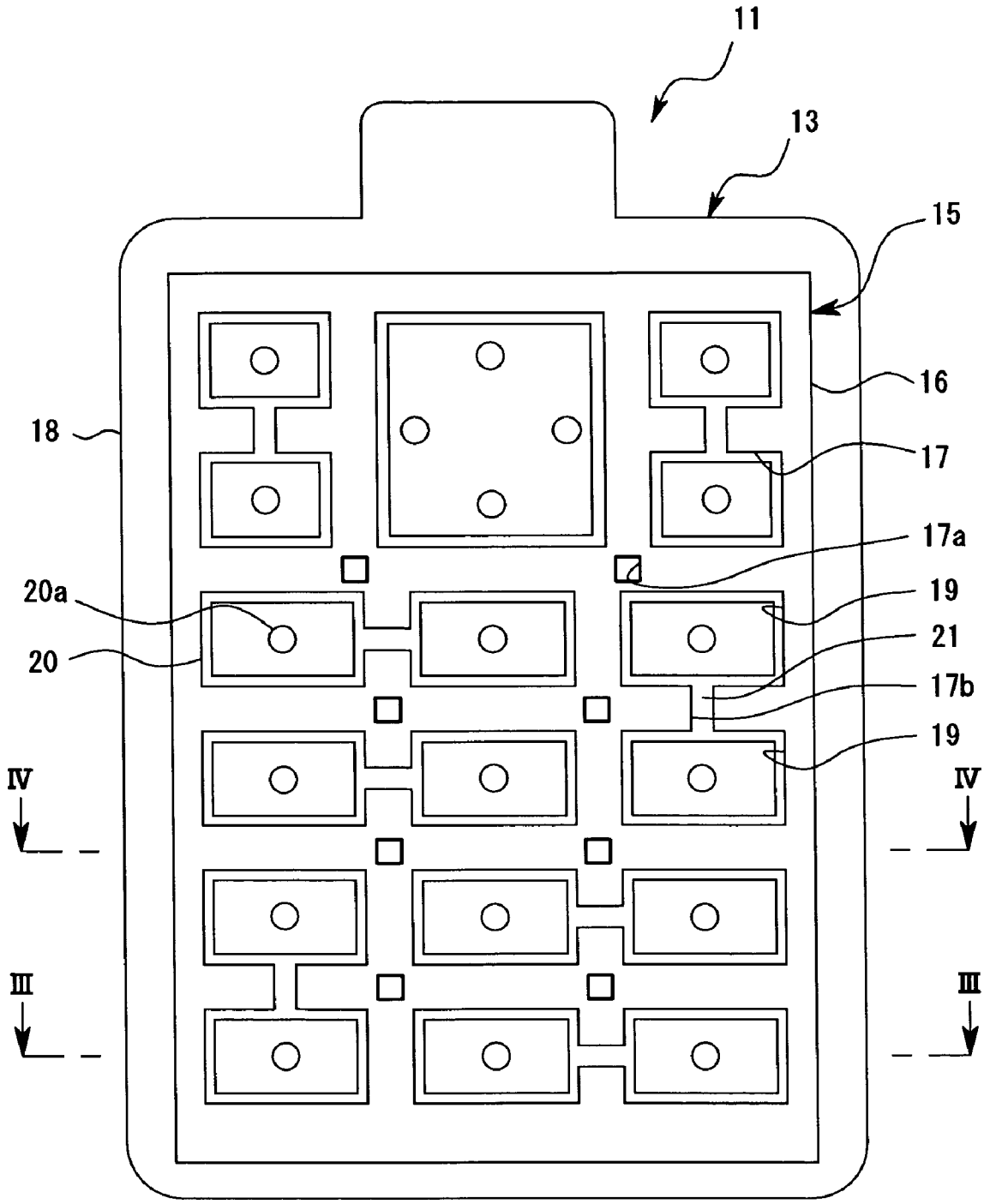
FIG. 2 is a plan view of the back surface of a key sheet according to the first embodiment of the present invention.

As shown in FIGS. 1 and 2, a key sheet 11 of the first embodiment is of a type in which keytops 12 are exposed through individual operation openings 3 formed in a casing 2 of an electronic device 1. This electronic device 1 being a mobile phone, a PDA, a car navigation apparatus, or a car audio apparatus, or any other electronic device having a pushbutton switch key sheet is within the scope of the present invention.

Figure 3:
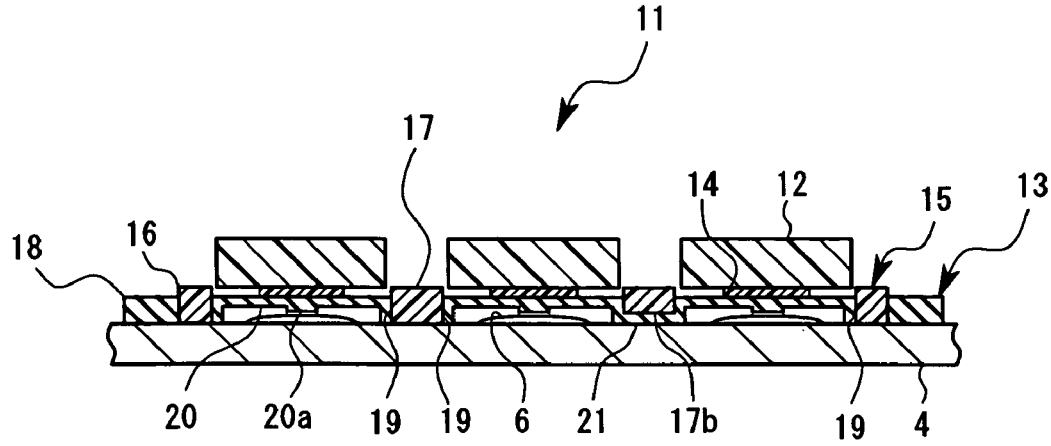
FIG. 3 is a sectional view taken along the line III-III of FIG. 2 for showing the key sheet in use.
Figure 4:
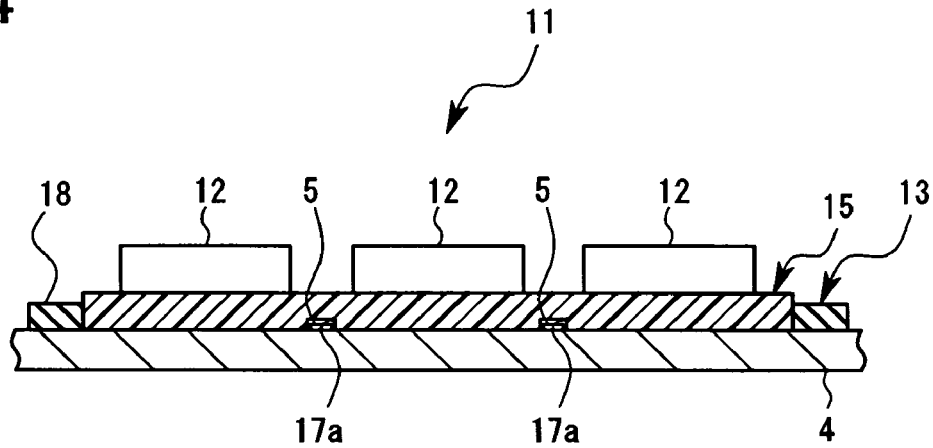
FIG. 4 is a sectional view taken along the line IV-IV of FIG. 2 for showing the key sheet in use.

As shown in FIGS. 2 through 4, the key sheet 11 is composed of a plurality of keytops 12 and a base sheet 13. Of these, the keytops 12 are fixed to the base sheet 13 through the intermediation of adhesion layers 14 (FIG. 3). When the key sheet 11 is formed as an illumination type key sheet, the material of the keytops 12 is one which is entirely or partially translucent. In this case, the material of the adhesion layer 14 is also translucent. In particular, the material of the adhesion layer 14 is colorless and transparent.

The base sheet 13 is equipped with a hard base plate 15 formed of a translucent hard resin as a base. The hard base plate 15 is composed of an annular outer frame portion 16 and a lattice-like inner frame portion 17 extending on the inner side of the annular outer frame portion 16.

On the outer side of the outer frame portion 16, there is formed a holding/receiving portion 18 formed of a rubber-like elastic material. The back surface of the casing 2 of the electronic device 1 and a printed circuit board 4 are contained in the casing 2 pressurize and hold the holding/receiving portion 18 therebetween, whereby the key sheet 11 is attached to the electronic device 1.

Formed in the inner frame portion 17 are a plurality of accommodation recesses 17*a*, where there are accommodated inner light sources 5, such as chip light-emitting diodes (LEDs), protruding from the printed circuit board 4 of the electronic device 1.

Formed in the hard base plate 15 are a plurality of through-holes 19 defined by the outer frame portion 16 and the inner frame portion 17 in correspondence with the fixing positions of the keytops 12. In the portions of the inner frame portion 17 between the adjacent through-holes 19, there are formed bottomed communicating grooves 17*b*, which are formed by partially reducing the plate thickness.

The through-holes 19 are blocked by operating portions 20 formed of a rubber-like elastic material and adapted to floatingly support the keytops 12 so as to allow displacement under pressurization. The adjacent operating portion 20 is formed serially and integrally through connecting portions 21 filling the communicating grooves 17*b*. The upper surfaces of the operating portions 20 are situated within the through-holes 19, and are one step lower than the surface of the hard base plate 15. The keytops 12 are fixed to these upper surfaces, which are one step lower, through the intermediation of adhesion layers 14 formed within these upper surfaces. On the lower surfaces of the operating portions 20, there are formed pushers 20*a*, the forward end portions of which are opposed to contact disc springs 6 constituting the contact switches of the printed circuit board 4.

Next, the materials of the components of the key sheet 11 will be described.

The material of the hard base plate 15 of the base sheet 13 is rigid enough not to cause the key sheet 11 to be bent by the weight of the keytops 12 even when the electronic device 1 is set upright, or it is placed obliquely or with the keytop 12 side thereof facing downwards. More specifically, examples of the materials for the hard base plate 15 include a polycarbonate resin, a polymethyl methacrylate resin, a polyproylene resin, polystyrene-based resins, polyacrylic-based copolymer resins, polyolefin-based resins, an acrylonitrile butadiene styrene resin, polyester-based resins, epoxy-based resins, polyurethane-based resins, a polyamide resin, and silicone-based resins. The key sheet 11 of this embodiment is an illumination type key sheet having accommodation recesses 17*a* for the inner light sources 5 in the hard base plate 15. Since light is guided through the plate thickness of the hard base plate 15, there is used, in particular, a colorless transparent material for the hard base plate 15. More specifically, of those, a transparent polycarbonate resin or a transparent polypropyrene resin is particularly used as a preferable material.

As the rubber-like elastic material forming the holding/receiving portion 18, the operating portion 20, and the connecting portions 21, it is possible to use a thermosetting elastomer with satisfactory resiliency, such as silicone rubber, isoprene rubber, ethylene propylene rubber, butadiene rubber, chloroprene rubber, or natural rubber. Further, it is also possible to use as this rubber-like elastic material a thermoplastic elastomer such as styrene-based, ester-based, urethane-based, olefin-based, amide-based, butadiene-based, ethylene-vinyl-acetate-based, fluoro-rubber-based, isoprene-based, or chlorinated polyethylene based thermoplastic elastomer. Of these, silicone rubber, styrene-based thermoplastic elastomers, and ester-based thermoplastic elastomers make it possible to obtain a key sheet 11 with particularly satisfactory resiliency for the operating portions 20 and high durability.

The keytops 12 may be formed of the same material as the hard base plate 15, the operating portions 20, and the connecting portions 21. Further, due to the rigidity of the hard base plate 15, it is also possible to use as the hard base plate 15 a heavy material, such as metal or wood. Further, as the adhesion layers 14 for the adhesion of the keytops 12, it is possible to use an ultraviolet setting type adhesive that cures in seconds.

Next, a method of manufacturing the key sheet 11 will be described. The keytops 12 and the base sheet 13 are produced separately. In producing the base sheet 13, the hard base plate 15 is obtained by molding, such as injection molding. When a thermosetting elastomer is selected as the rubber-like elastic material for the holding/receiving portion 18, the operating portions 20, and the connecting portions 21, the hard base plate 15 is placed in a cavity 24*a* of a mold 24 composed of an upper mold 22 and a lower mold 23. When a thermoplastic elastomer is selected, the hard base plate 15 is placed in the cavity 24*a* of the mold 24 for injection molding. Then, liquid elastomer is poured in from inlets 24*b* opening above the communicating grooves 17*b* to effect molding. At this time, the communicating grooves 17*b* communicate with the adjacent through-holes 19, so the liquid elastomer is poured into both through-holes 19. Thereafter, a post processing according to the material, whereby it is possible to obtain the base sheet 13, in which the operating portions 20, and the connecting portions 21 are integrally formed on the hard base plate 15. Instead of this manufacturing method, there is also a possible method in which the hard base plate 15 and the operating portions 20, and the connecting portions 21 are formed by two-color molding. Finally, predetermined keytops 12 are fixed to the respective operating portions 20 through the intermediation of the adhesive layers 14, whereby the key sheet 11 of this embodiment is obtained.

Next, the operation and effect of the key sheet 11 of this embodiment and the manufacturing method thereof will be described.

The communicating grooves 17*b* leading to the plurality of through-holes 19 are formed in the hard base plate 15 to connect the plurality of through-holes 19 as a series of spaces, and the connecting portions 21 connecting the operating portions 20 to the communicating grooves 17*b* are formed integrally as moldings connected to the operating portions 20, so there is no need to form in the mold 24 inlets 24*b* corresponding to the individual through-holes 19. As a result, the mold structure can be simplified, thereby achieving a reduction in cost. Further, since the plurality of operating portions 20 are integrally formed through the connecting portions 21 in the communicating grooves 17*b*, there is no need to cover the front surface or the back surface of the hard base plate 15 with a rubber-like elastic material, thereby achieving a general reduction in the thickness of the base sheet 13.

The upper surfaces of the operating portions 20 elastically supporting the keytops 12 are formed at the in-hole positions of the through-holes 19 lower than the surface of the hard base plate 15. As a result, it is possible to reduce the height by which the fixed keytops 12 protrude from the hard base plate 15, thereby achieving a reduction in the thickness of the key sheet 11.

Since the connecting portions 21 are formed within the plate thickness of the hard base plate 15, the connecting portions 21 do not protrude beyond the surface of the hard base plate 15, thereby achieving a reduction in the thickness of the key sheet 11.

Even in the case in which the connecting portions 21 have inlets 24*b* for the rubber-like elastic material and in which the operating portions 20 are formed by injection molding of thermoplastic elastomer, which leaves relatively large molding marks, the molding marks exist on none of the operating portions 20 but on the connecting portions 21. Thus, there is no disadvantage of the keytops 12 being obliquely fixed due to the protrusion of molding marks on the upper surfaces of the operating portions 20 to thereby impair the outward appearance of the key sheet 11. Further, nor is there fear of the contact disc springs 6 being erroneously turned on due to the protrusion of the molding marks on the lower surfaces of the operating portions 20. Further, even when the key sheet 11 is formed as an illumination type key sheet, it is also possible to avoid unevenness in illumination of the keytops 12 since there are no molding marks on the operating portions 20.

Since the hard base plate 15 is formed of a translucent resin, the light emitted from the inner light sources 5 is guided from the accommodation recesses 17*a* throughout the plate thickness of the translucent hard base plate 15, so that it is possible to brightly illuminate the entire surface of the key sheet 11. Thus, even when the use of a separate light guide plate is abolished, it is possible to brightly illuminate the keytops 12.

The adhesion layers 14 are applied not to the entire upper surfaces of the operating portions 20 but partially to portions within the upper surfaces thereof, so that when the keytops 12 are depressed, the operating portions 20 undergo elastic deformation on the outer periphery side of the adhesion layers 14, making it possible for the keytops 12 to be displaced. Thus, there is no need to form thick-walled protrusions on the upper surfaces of the operating portions 20 in order to raise the back surfaces of the keytops 12 from the above-mentioned upper surface, whereby the base sheet 13 can be so much the thinner and lighter.

The holding/receiving portion 18 is formed over the entire periphery of the outer frame portion 16 of the hard base plate 15, and is held between the back surface of the casing 2 and the printed circuit board 4. As a result, watertightness of the electronic device 1 may be secured.

Second Embodiment

Figure 6:
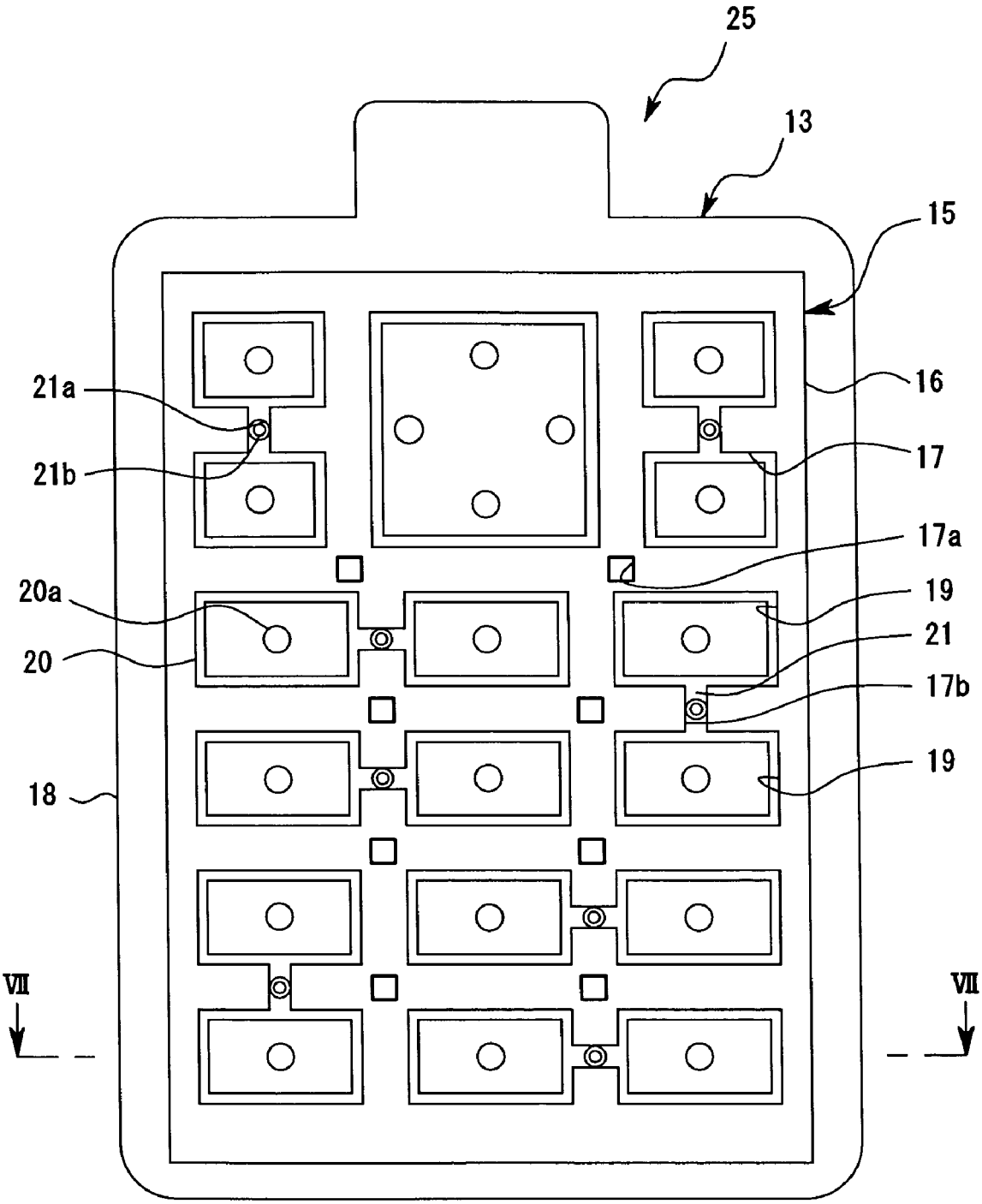
FIG. 6 is a plan view of a back surface of a key sheet according to the second embodiment of the present invention.
Figure 7A:
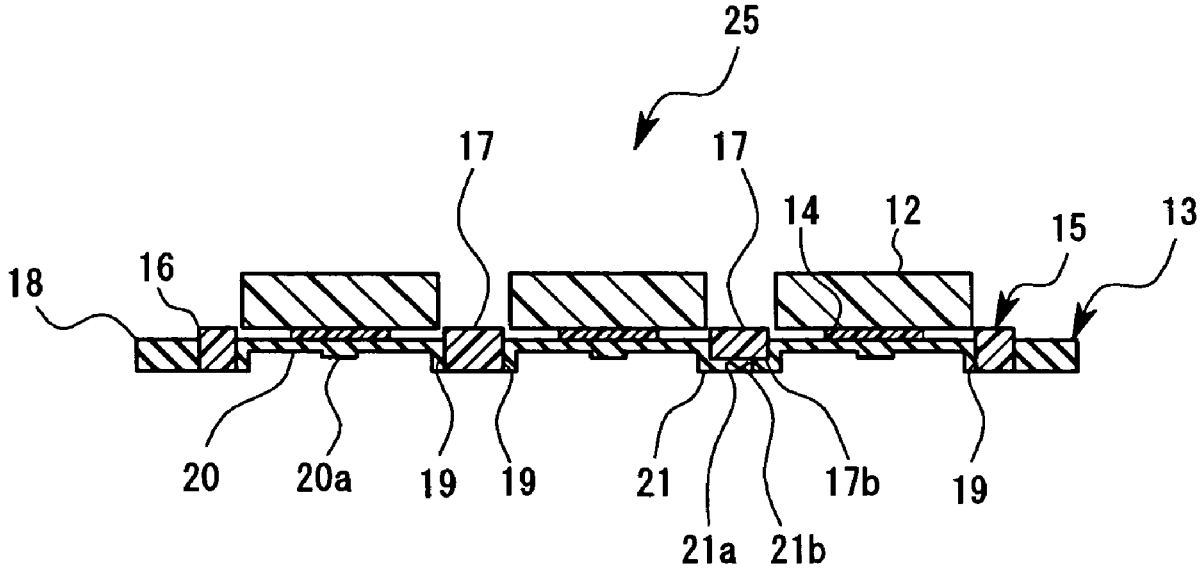
Figure 7B:
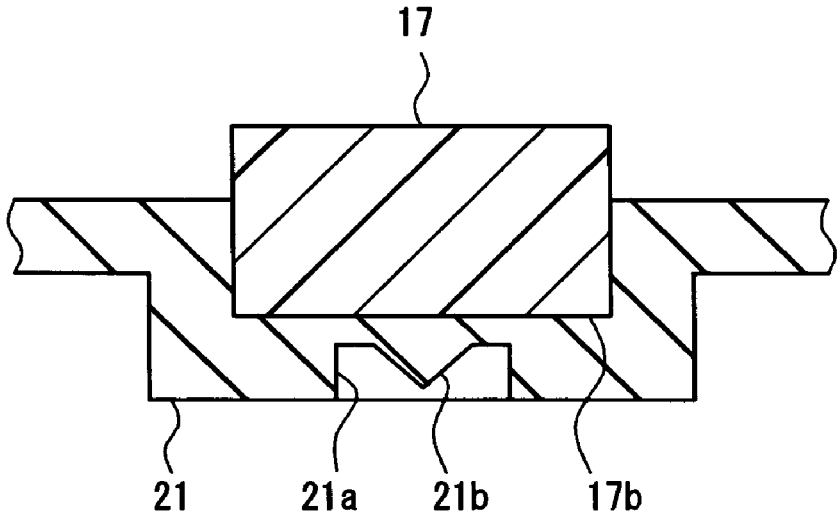

FIGS. 6, 7A, and 7B

As shown in FIGS. 6, 7A, and 7B, a key sheet 25 according to the second embodiment differs from the key sheet 11 of the first embodiment in that recesses 21*a* are formed in the connecting portions 21, and molding marks 21*b* exist in the recesses. Otherwise, the operation and effects of this embodiment are the same as those of the first embodiment.

That is, in this embodiment, the holding/receiving portion 18, the operating portions 20, and the connecting portions 21 are formed by injection molding of thermoplastic elastomer, which leaves relatively large molding marks 21*b*. However, even if injection molding of a thermoplastic elastomer is effected, the molding marks 21*b* remain within the depth of the recesses 21*a*, and do not protrude beyond the surface of the base sheet 13. Thus, it is advantageously possible to install the key sheet 25 in a stable attitude without involving any looseness with respect to the printed circuit board 4.

Third Embodiment

Figure 8:
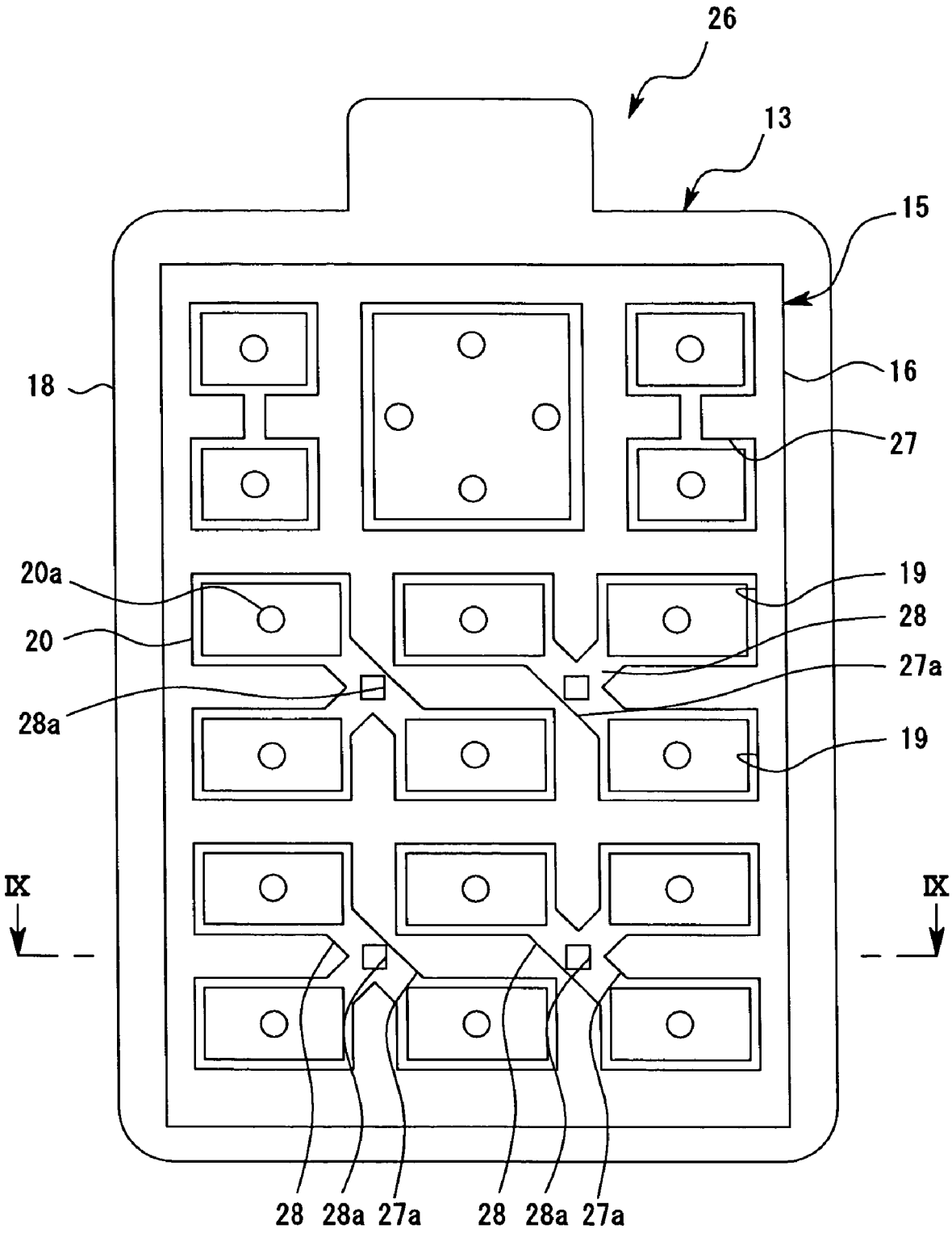
FIG. 8 is a plan view of the back surface of a key sheet according to the third embodiment of the present invention.
Figure 9:
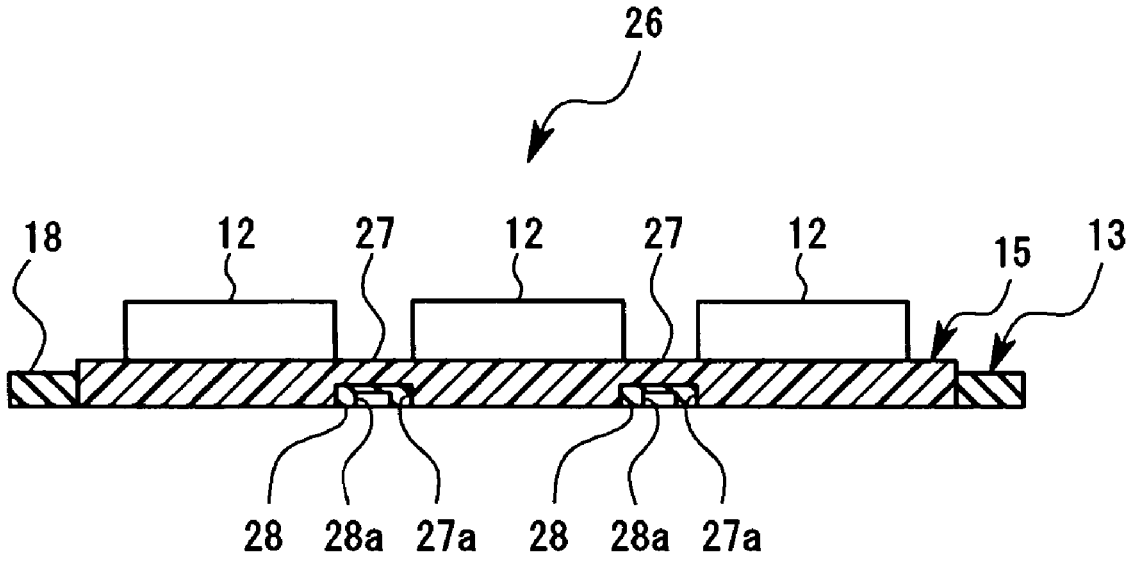
FIG. 9 is a sectional view of the key sheet taken along the line IX-IX of FIG. 8.
Figure 10:
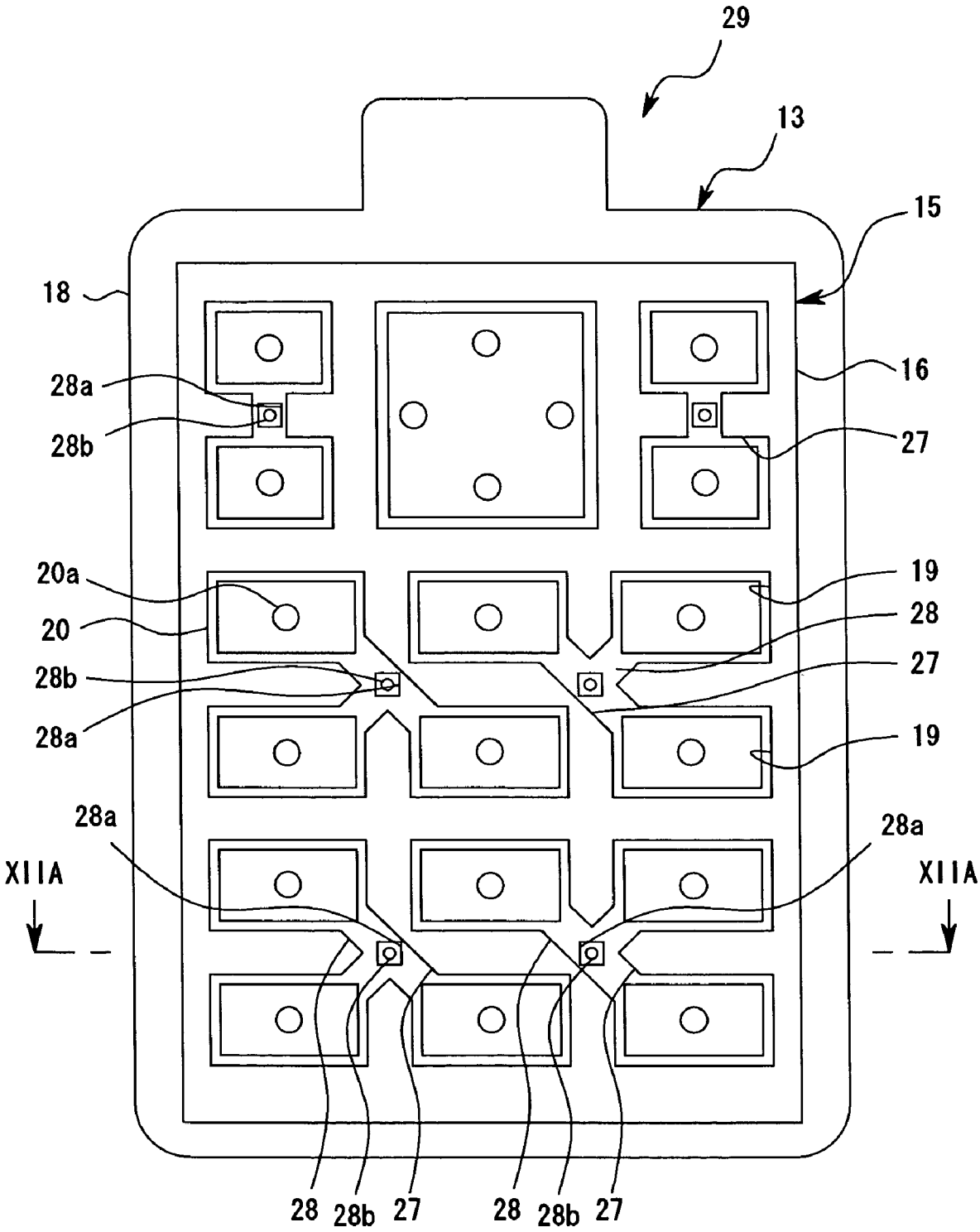
FIG. 10 is a plan view of a back surface of a key sheet according to a fourth embodiment of the present invention.

FIGS. 8 and 9

FIGS. 8 and 9 show a key sheet 26 according to the third embodiment. The key sheet 26 of the third embodiment differs from the key sheet 11 of the first embodiment in the construction of communicating grooves 27*a* of an inner frame portion 27 and connecting portions 28. That is, each bottomed communicating groove 27*a* formed in the hard base plate 15 leads to three through-holes 19, with the connecting portion 28 being integrally formed so as to connect them together.

In the connecting portions 28, there are formed accommodation recesses 28*a* for the inner light sources 5, which means that the key sheet 26 is an illumination type key sheet, in which light is guided to the operating portions 20 through the wall thickness of the connecting portions 28. Thus, of the materials mentioned with reference to the first embodiment, a colorless and transparent material is used as the material as the rubber elastic material forming the connecting portions 28. More specifically, a colorless and transparent silicone rubber is used in this embodiment. Further, for light guidance through the connecting portions 28, of the materials as mentioned with reference to the first embodiment, one differing from the connecting portions 28 in refractive index is used as the material of the hard base plate 15 of this embodiment. More specifically, a white polycarbonate resin is used in this embodiment. By thus forming the connecting portions 28 of a colorless and transparent material and the hard base plate 15 of a white material, the light from the inner light sources 5 is guided from the connecting portions 28 to the operating portions 20 while being reflected at the interface between the connecting portions 28 and the hard base plate 15, making it possible to brightly illuminate the keytops 12. Further, since the distance from the accommodation recesses 28*a* to the operating portions 20 is the same all over, it is also possible to attain uniform illumination for the keytops 12. The light entering the hard base plate 15 is diffused by the white pigment, and is not absorbed.

Figure 5:
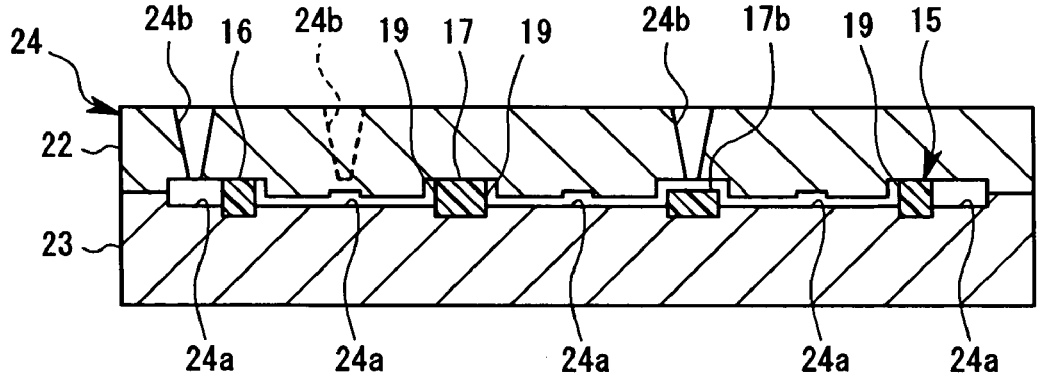
FIG. 5 is a sectional view of a mold for illustrating a key sheet manufacturing method of the present invention.

Further, the connecting portions 28 are formed of a colorless and transparent silicone rubber, which is a thermosetting elastomer. Thus, unlike a thermoplastic elastomer, which leaves relatively large molding marks, no large molding marks are left. Thus, it is possible to use the mold 24 of the first embodiment as shown in FIG. 5, in which the inlets 24*b* are open above the communicating grooves 17*b*. In this embodiment, however, it is also possible to use a mold in which inlets are open above the operating portions 20.

Fourth Embodiment

FIGS. 10, 11, 12A, and 12B

Figure 11:
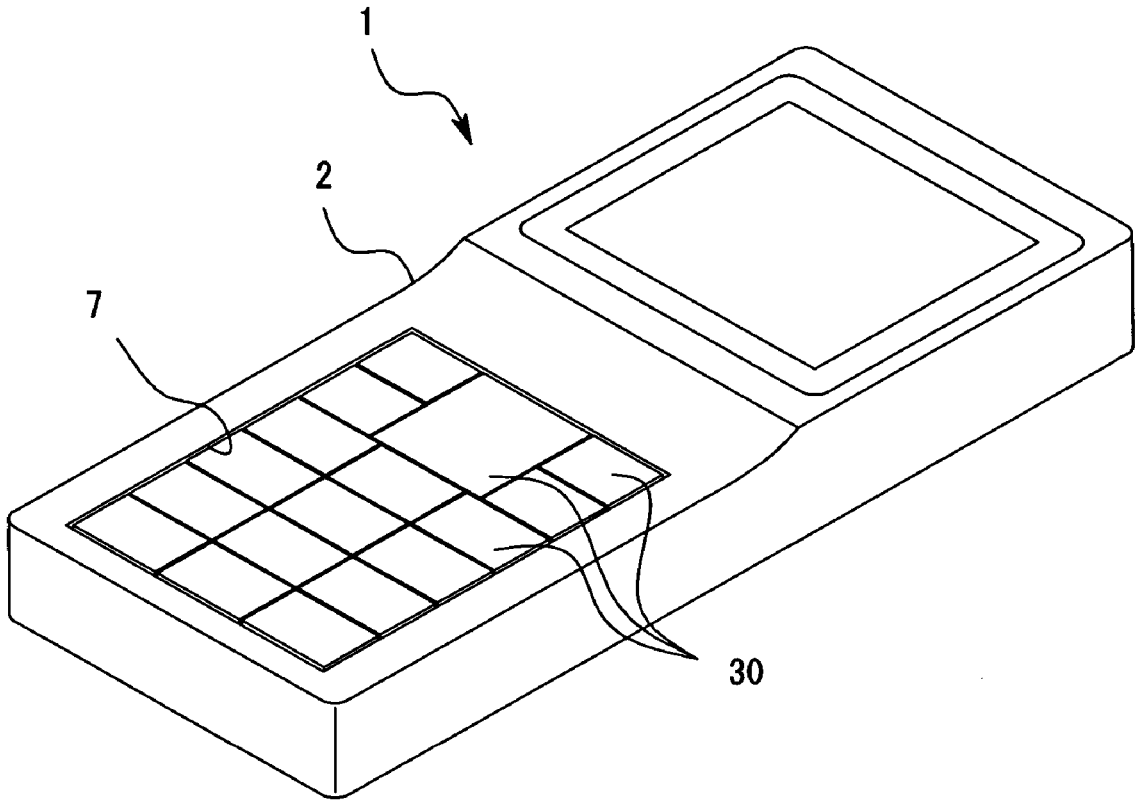
FIG. 11 is an outward perspective view of an electronic device equipped with a key sheet according to the fourth embodiment of the present invention.
Figure 12A:
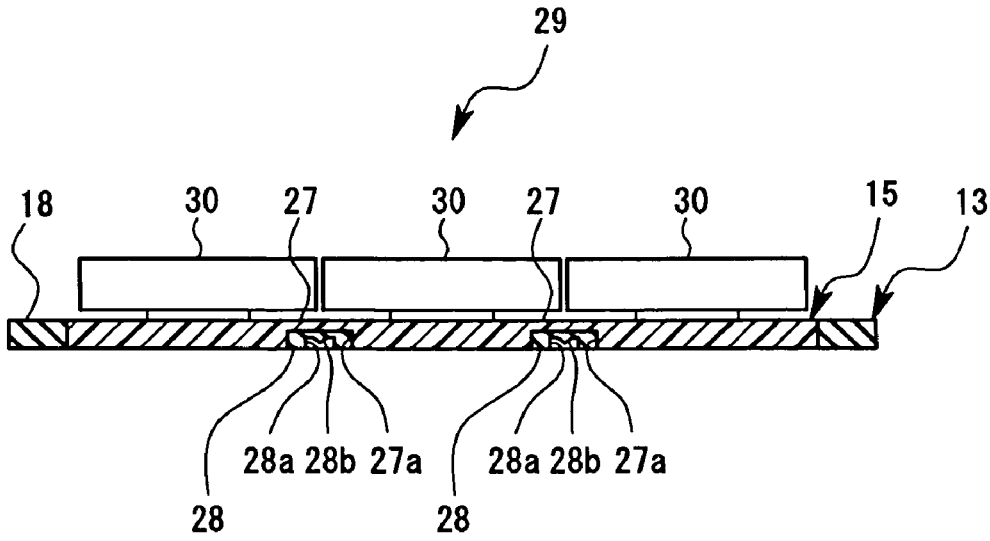
Figure 12B:
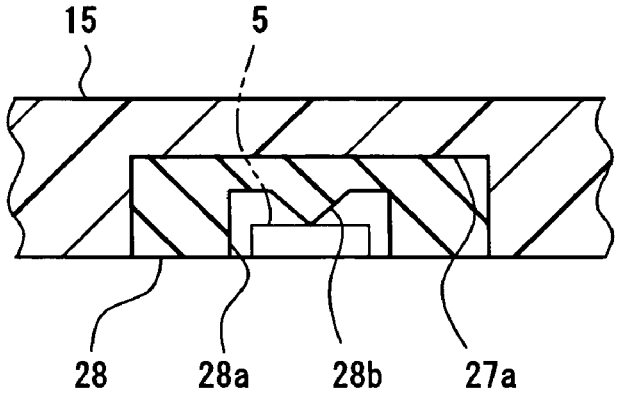

A key sheet 29 according to the fourth embodiment is a modification of the key sheet 26 of the third embodiment. As shown in FIG. 11, the key sheet 29 is formed as a small-pitch key sheet, in which the plurality of keytops 30 are collectively exposed through the operation opening 7 with no partition frame formed in the casing 2 of the electronic device 1. The interval between the keytops 30 is very small and ranges, for example, approximately from 0.15 mm to 0.2 mm; the distance between the keytops and the operation opening 7 is approximately as small as that.

Further, as shown in FIGS. 10, 11, 12A, and 12B, molding marks 28*b* exist in the accommodation recesses 28*a* of the connecting portions 28. That is, in this embodiment, the operating portions 20 and the connecting portions 28 are formed through injection molding of a thermoplastic elastomer. More specifically, a colorless and transparent styrene-based thermoplastic elastomer is used as the material. If the holding/receiving portion 18, the operating portions 20, and the connecting portions 28 are formed through injection molding of a thermoplastic elastomer, which leaves relatively large molding marks 28*b*, the molding marks 28*b* remain within the accommodation recesses 28*a*. Thus, it is advantageously possible to install the key sheet 29 in a stable attitude without involving any looseness with respect to the printed circuit board 4. Further, specifically speaking, the hard base plate 15 is formed of a black and light-blocking polypropylene resin. Thus, while a part of it is absorbed by the hard base plate 15, the light emitted from the inner light sources 5 enters the operating portions 20 through the connecting portions 28, making it possible to illuminate the keytops 30 effectively only from the back side thereof.

Modifications of the Embodiments

Modifications of the above-described embodiments will be described below.

Figure 14:
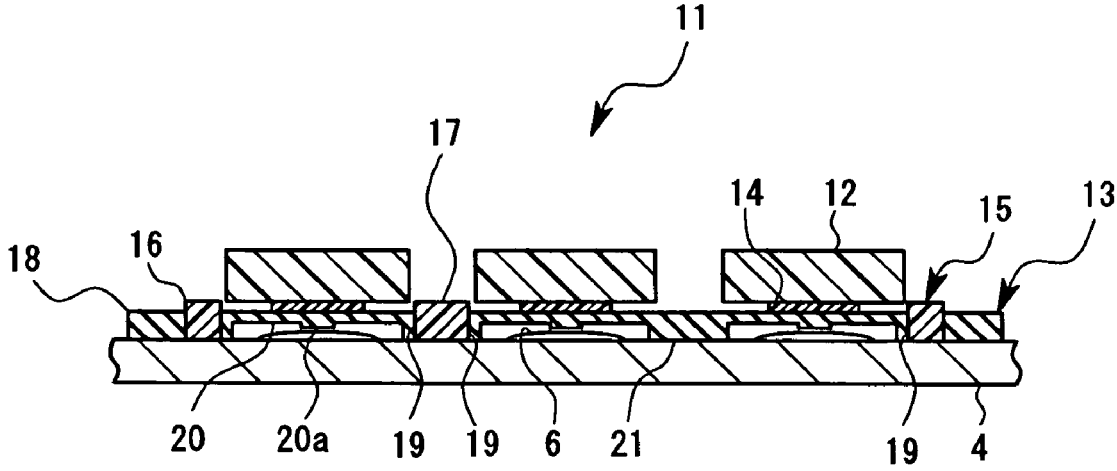
FIG. 14 is a sectional view (corresponding to FIG. 3) of a modification of the embodiments of the present invention.

While in the above-described embodiments the communicating grooves 17*b*, 27*a* are formed without allowing them to extend through the wall thickness of the inner frame portion 17, 27, it is also possible to form them as through-holes as shown in FIG. 14. Further, while in the above-described embodiments the communicating grooves 17*b*, 27*a* are formed in the back surface of the hard base plate 15, it is also possible to form them in the front surface of the hard base plate 15, with the connecting portions 21, 28 being formed therein.

Figure 13:
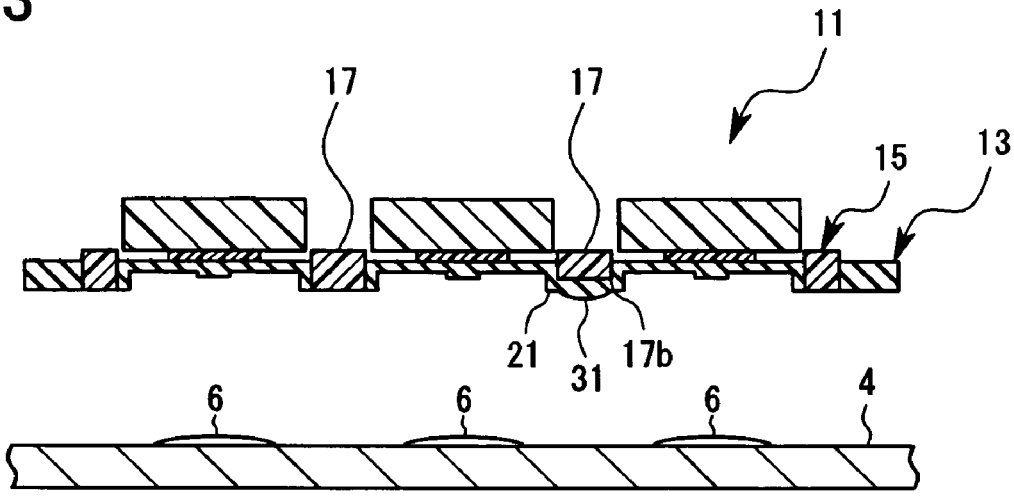
FIG. 13 is an enlarged main portion sectional view of a modification of the embodiments of the present invention.

While in the above-described embodiments the connecting portions 21, 28 do not protrude from the back surface of the hard base plate 15, as shown, for example, in FIG. 13, in the case of the key sheet 11 of the first embodiment, it is also possible to form on the connecting portions 21 buffer portions 31 downwardly protruding from the back surface of the hard base plate 15. In this construction, when the key sheet 11 is pressurized by an external force, the buffer portions 31 come into elastic contact with the printed circuit board 4, making it possible to avoid large-pressure contact of the hard base plate 15 (inner frame portion 17) and to suppress damage or deformation of the printed circuit board 4.

In the above-described embodiments, it is possible to form the keytops 12, 30 of a rubber-like elastic material, such as a thermoplastic resin, a thermosetting resin, silicone rubber, or a thermoplastic elastomer. Further, it is possible to form on the keytops 12, 30 display portions indicating characters, figures, symbols, etc. in ink or by plating or the like. Further, the keytops 12, 30 may also be formed as open-character-illumination type keytops or character-illumination type keytops. Further, the three-dimensional configuration of the keytops 12, 30 may be other than that described above.

While in the above-described embodiments the operating portions 20 are rectangular in plan view, they may also be of a circular, an elliptical, or some other polygonal configuration. Further, the configuration of the base sheet 13 and the configuration of the connecting portions 21, 28 are not restricted to those of the above-described embodiments; it is also possible to form them in some other configurations.

While the key sheet 11, 25, 26, 29 of the above-described embodiments is used in the electronic device 1, it may also be formed as the key sheet of some other apparatuses, such as a PDA or a remote controller.

What is claimed is:

1. A key sheet comprising:

a base sheet having a hard base plate and operating portions, the hard base plate including a plurality of through-holes and the operating portions being formed of a rubber-like elastic material, the rubber-like elastic material elastically being integral with the base plate and supporting keytops at the through-holes and allowing displacement of the keytops under pressurization, wherein the hard base plate has a communicating groove extending between the plurality of through-holes, and wherein a connecting portion connecting the operating portions is integrally formed in the communicating groove.

2. A key sheet according to claim 1, wherein the communicating groove is formed as a bottom groove that is formed by partially reducing the thickness of the hard base plate.

3. A key sheet according to claim 1, wherein the communicating groove includes a through-hole that extends through the hard base plate.

4. A key sheet according to claim 1, wherein the key sheet is formed such that upper surfaces of the operating portions are lower than the surface of the hard base plate.

5. A key sheet according to claim 1, wherein the connecting portion is formed to be within the thickness of the hard base plate.

6. A key sheet according to claim 1, wherein a buffer portion protruding from the surface of the hard base plate is formed on the connecting portion.

7. A key sheet according to claim 1, wherein the key sheet has a molding mark on the connecting portion.

8. A key sheet according to claim 1, wherein a recess is formed in the connecting portion, and wherein the key sheet has a molding mark in the recess.

9. A key sheet according to claim 1, wherein the plurality of operating portions and the connecting portions are formed of a translucent rubber-like elastic material, and wherein recesses for accommodating inner light sources are formed in the connecting portions.

10. A key sheet according to claim 1, wherein the rubber-like elastic material is colorless and transparent, and wherein the hard base plate is formed of a white material differing from the rubber-like elastic material in refractive index.

11. A key sheet according to claim 1, wherein the hard base plate is translucent.

12. A key sheet according to claim 1, wherein the base sheet of the key sheet is equipped with the keytops and wherein the key sheet is formed as a small-pitch key sheet in which the interval between the keytops is small and in which the plurality of keytops are collectively exposed through an operation opening formed in an electronic apparatus.

13. A key sheet according to claim 12, wherein the keytops are arranged at an interval of 0.15 mm to 0.2 mm.

14. A key sheet manufacturing method in which a hard base plate having a plurality of through-holes formed so as to penetrate the base plate is placed in a mold, operating portions blocking the through-holes are formed through molding of a rubber-like elastic material, and keytops are then fixed to the operating portions, the key sheet manufacturing method comprising the steps of:

forming the hard base plate having the plurality of through-holes and a communicating groove leading to the plurality of through-holes;

forming, integrally on the hard base plate, the plurality of operating portions and a connecting portion connecting the operating portions with each other by pouring the rubber-like elastic material from an inlet of the mold, with the inlet being open at a position corresponding to one of the through-holes or to the communicating groove; and fixing the keytops respectively to the operating portions.

* * * * *